United States Patent [19]

Fontenot

[11] Patent Number: 4,703,832

[45] Date of Patent: Nov. 3, 1987

[54] SAFETY ESCAPE APPARATUS FOR ELEVATED STRUCTURES

[76] Inventor: Ozeman J. Fontenot, 109 Pullin St., Youngsville, La. 70592

[21] Appl. No.: 894,573

[22] Filed: Aug. 8, 1986

[51] Int. Cl.[4] ..... A62B 1/20

[52] U.S. Cl. ..... 182/100; 182/189

[58] Field of Search ..... 182/100, 189, 3, 2

[56] References Cited

U.S. PATENT DOCUMENTS

| | | | |
|---|---|---|---|
| 647,845 | 4/1900 | King | 182/100 |
| 2,658,702 | 11/1953 | Osborne | 182/189 |
| 2,725,853 | 12/1955 | Nordheim | 182/3 |
| 3,137,487 | 6/1964 | Lesser | 182/3 |
| 3,880,254 | 4/1975 | Fitzgerald | 182/10 |
| 4,203,504 | 5/1980 | Reynoir | 182/10 |
| 4,341,286 | 7/1982 | Gregory | 182/100 |
| 4,425,982 | 1/1984 | Kibbie | 182/3 |
| 4,440,261 | 3/1984 | Clark | 182/3 |

*Primary Examiner*—Reinaldo P. Machado
*Attorney, Agent, or Firm*—Keaty & Keaty

[57] ABSTRACT

An escape apparatus for elevated structures, such as multi-story buildings, offshore platforms and the like. An elongated pole is pivotally connected to the elevated structure to move between a stored position, in substantial alignment with a horizontal level of the structure, and a ready, substantially vertical position. A person escapes the elevated structure by sliding down the vertically positioned pole.

17 Claims, 7 Drawing Figures

SAFETY ESCAPE APPARATUS FOR ELEVATED STRUCTURES

BACKGROUND OF THE INVENTION

The present invention relates to safety devices for elevated structures, more particularly, it relates to apparatus to facilitate the evacuation of persons from elevated structures.

Oil and gas drilling rigs and production platforms, by virtue of the volatile, flammable nature of the products with which they deal, are sometimes exposed to explosions and fires. Although the occurence of explosions and fires is infrequent, they present an extremely hazardous situation for personnel on the drilling rig or production platform. Immediate, fast and safe evacuation of personnel is essential to prevent loss of life or limb. When these rigs are located on shore, the majority of the rig personnel is close to ground level and can simply run away from the rig. When drilling, producing or reworking operations are being carried out offshore, the rigs normally are located on an offshore platform. These platforms are usually at a considerable height above normal water level to isolate the platform from the effects of wave action present during rough seas. Therefore, personnel on these offshore platforms have the additional problem of descending to the level of the water so that they can move away from the rig. Merely jumping from the platform is neither a practical nor safe way of evacuating since the impact upon hitting the water could seriously injure the person. Accordingly, many systems and devices have been proposed to provide for the safe evacuation of personnel from an offshore platform during an emergency.

One system which is known to the applicant of the present application is disclosed in U.S. Pat. No. 4,202,427. It comprises an A-frame which is pivotally attached to the rig and, in the standby position, is oriented vertically. A personnel capsule is suspended by a cable from the A-frame. In the event of an emergency, personnel enter the capsule and activate a release mechanism which allows the A-frame to pivot outwardly from the rig to a substantially horizontal position. The capsule then descends at a controlled rate of speed on the cable connected to the A-frame. The number of personnel which can escape in the device is limited by the number which can fit in the capsule.

Another system which has been proposed comprises a flexible chute connecting the platform with a boat. The material used to make the chute is usually either easily melted by intense heat or is flammable, with the result that the chute is burned or otherwise rendered inoperative before it can be used.

U.S. Pat. No. 4,203,504 discloses a system for evacuating personnel from an offshore platform comprising a stable buoyant structure anchored a distance from the platform with cables connecting the structure and the platform. In an emergency situation, rig or platform personnel are evacuated in personnel carriers which descent on the cables from the platform to the buoyant structure. Because this system requires the use of so much auxiliary equipment, such as the buoyant structure and enough personnel carriers to evacuate all personnel which might be on the rig or platform at any given time, it is relatively expensive. Also, the buoyant structure and the cables connecting it to the platform may interfere with boat traffic around the platform and become damaged.

U.S. Pat. No. 3,880,254 discloses three embodiments of a system for evacuating personnel from an offshore platform. In the first embodiment, a boom is pivotally attached at its lower end to the legs of the platform, below the surface of the water. The boom is normally stored in a substantially vertical orientation, with the upper end of the boom adjacent the deck level of the platform. A head is connected to the upper end of the boom, and life lines are connected between the head and the platform. When an emergency situation arises, the boom pivots outwardly from its vertical standby position to a substantially horizontal position in which the head is at a water level. Personnel to be evacuated then descend via the life lines, which extend at an angle from the platform to the head. A disadvantage of this embodiment is that, in the stored position, the boom extends upwardly from below the water line, and is vulnerable to contact with supply boats around the platform, which could damage the boom. Another disadvantage is that flammable lines may burn or melt and steel cables may fray and injure those trying to use the escape device. In the second embodiment, the boom comprises a stairway which is pivotally attached at its upper end to the platform, adjacent the deck level. A buoyant head is connected to its lower end. It is stored, substantially vertically, with the head below water level. When the boom is needed, the buoyant head is allowed to lift the lower end of the boom to the surface of the water. At this time, the boom is at an angle to the vertical. Rig personnel then descend to the water level via the stairs on the boom. In addition to suffering from the first-mentioned disadvantage of the first embodiment, in this embodiment the time for evacuation of the personnel is increased due to the angular orientation of the boom. This added time is particularly disadvantageous in emergency situations when time is of the essence. Also, in their haste to evacuate the platform, the personnel may trip down the stairs and injure themselves. Furthermore, since some of the stairs are stored underwater, sea fauna and flora may attach themselves to the stairs, causing an extremely slippery surface. In the third embodiment, the boom also comprises stairs and buoyant head connected to a lower end of the boom. However, the upper end of the boom is pivotally connected to the platform adjacent the deck level. The boom is stored in a substantially horizontal position alongside the deck level of the platform. When needed, the boom swings outwardly and downwardly from the platform such that the lower end of the boom is adjacent the water level and the boom is at an angle to the vertical. As with the second embodiment, the time for personnel to descend from the platform is increased and there is the danger that offshore workers may trip on the stairs.

SUMMARY OF THE INVENTION

The present invention provides an apparatus, to facilitate the evacuation of personnel from elevated structures, such as offshore platforms and multi-story buildings during emergency situations.

The apparatus of the present invention comprises an escape pole means pivotally connected to an elevated structure. When in a stored position, the escape pole is aligned horizontally adjacent the elevated structure. When an emergency arises, such as a fire or explosion, a first latch means is opened and the pole means pivots into a substantially vertical position with its lower end adjacent a surface to which persons may evacuate. In a first embodiment of the present invention, persons may then hold onto the pole and slide down to the evacuation surface. In a second embodiment of the present invention, a novel cable and counterweight system is provided to assist in the evacuation of personnel from relatively high structures. A cable is connected at one end to a counterweight means disposed within the pole; its other end extends through a port in the upper portion of the pole, and is attached to a securing means. A person secures himself to the securing means and slides down the pole. As he slides down the pole, the counterweight means slides up in the pole; the gravitational force opposing the upward movement of the counterweight means partially counteracts the gravitational force on the person, slowing the person's descent and thereby reducing the force of his impact with the surface to which he is evacuating. When he reaches the evacuation surface, he detaches himself from the securing means, and the counterweight means returns the securing means to its ready position for the next person.

The substantially vertical orientation of the pole provides for rapid evacuation of personnel and substantially decreases the possibility of people falling away from the escape device as they descend, which is a major disadvantage of previous poles and life lines disposed at an angle to the evacuation surface. There is less chance that personnel will stop and remain at intervals on the vertical pole as they may on singular stairs or lines and prevent others from descending.

When used on an offshore platform, the pole will neither interfere with nor be damaged by boat traffic when in its stored position. The escape apparatus of the present invention is relatively simple and durable. It has few working parts susceptible to mechanical failure.

The pole can accommodate a variable number of persons, which lessens the danger that there may be more people on the elevated structure than can escape via the evacuation device of the present invention.

It is an object of the present invention to provide an escape apparatus which enables persons to rapidly evacuate from an elevated structure, such as an offshore platform, rig or high-rise building.

Another object of the present invention is to provide an escape apparatus for elevated structures which, without modification, can accommodate a variable number of people.

A further object of the present invention is to provide an escape apparatus for offshore platforms which, when in the stored position, will neither interfere with nor be damaged by boat traffic around the platform.

It is also an object of the present invention to provide a relatively simple and durable device for escaping from elevated structures and which has few working parts susceptible to mechanical failure.

BRIEF DESCRIPTION OF THE DRAWINGS

For a better understanding of the objects and advantages of the present invention, reference should be had to the following detailed description, taken in conjunction with the accompanying drawings in which like parts are given like reference numerals, and wherein.

DETAILED DESCRIPTION OF THE PREFERRED EMBODIMENT

The present invention will now be described, for purposes of illustration only, in conjunction with an offshore platform. The teachings of the present invention are equally applicable to use on a high-rise building.

Figure 1:
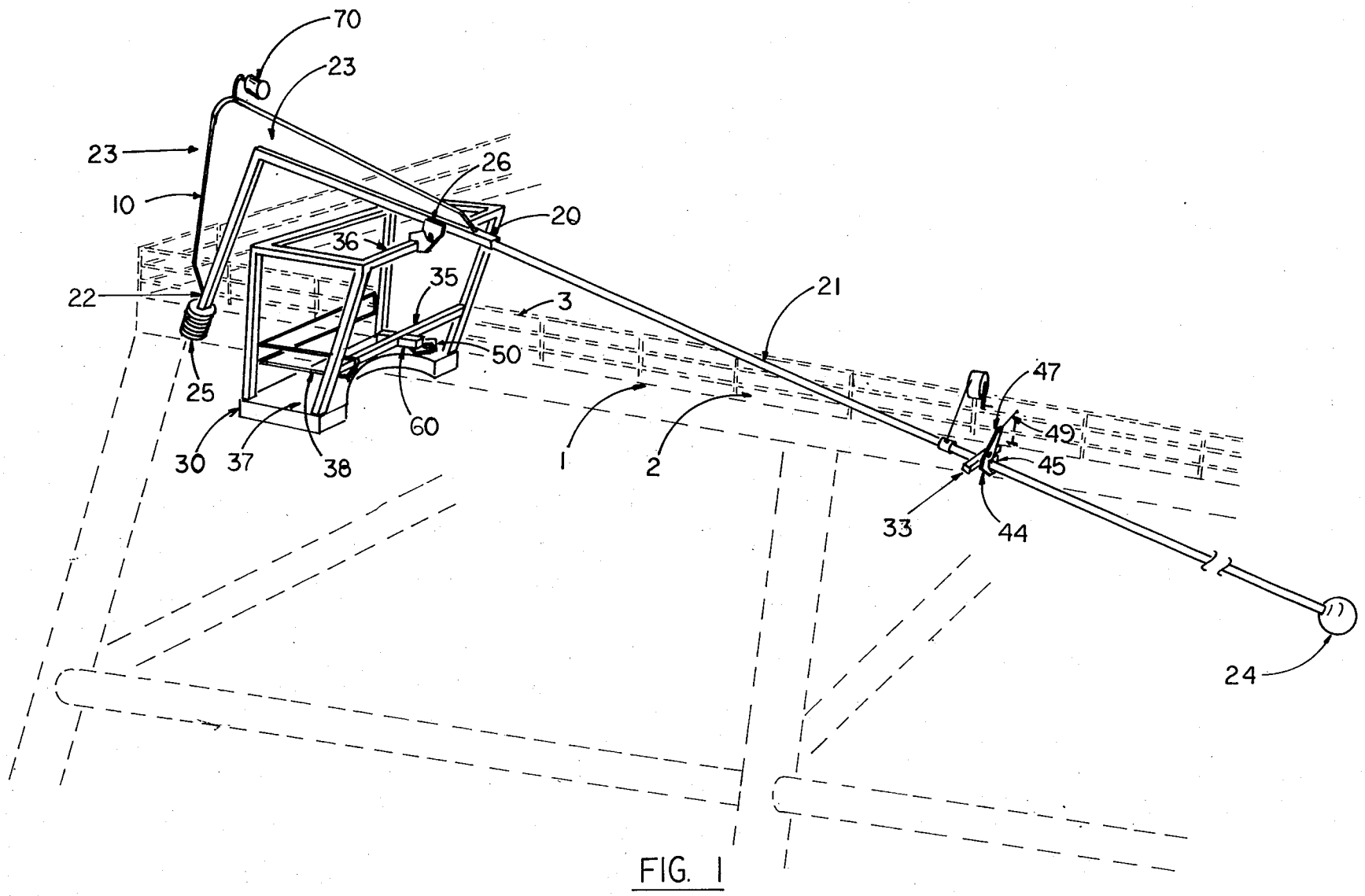
FIG. 1 is a perspective view of the preferred embodiment of the apparatus of the present invention in a stored position.
Figure 4:
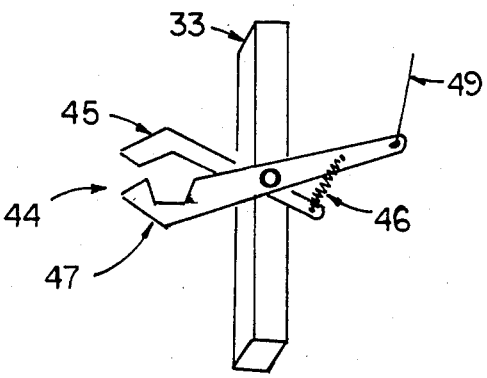
FIGS. 4 and 5 are top views of a release latch and a locking latch, respectively, used in accordance with the preferred and alternative embodiments of the present invention.
Figure 5:
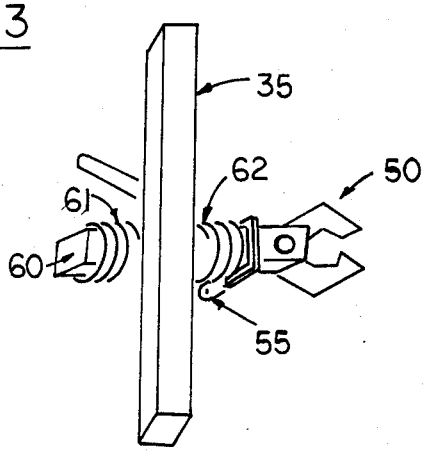

Referring now to FIG. 1, an escape apparatus 10 of the preferred embodiment of the present invention comprises a generally L-shaped escape pole means 20 pivotally mounted on a horizontal support member 36 of a support structure 30. Escape pole means 20 comprises an elongated section 21 and a shorter, counterbalance section 22, with a strongback 23 strengthening the substantially perpendicular connection between the two sections. A resilient guard means, preferably in a form of a rubber ball 24 or other similar resilient material, is disposed on the end of elongated section 21 distant from strongback 23, the purpose of which will be described further. A release latch 44 (shown more fully in FIG. 4) functions to retain escape pole means 20 in a stored position and has its short arm 45 rigidly attached to a bar 33 (FIG. 1) extending perpendicularly from an offshore platform 1. A spring 46, between short arm 45 and long arm 47, serves to close release latch 44. Release latch 44 is openable by a release means comprising remote release cable 49 interconnected between long arm 47 of release latch 44 and a band rail 3 of offshore platform 1. A second latch means 50 has its short arm 55 (FIG. 5) rigidly attached to a shock-absorbing means 60, which is in turn mounted on horizontal support member 35. Second latch means 50 secures escape pole means 20 in a vertical orientation when the pole is in use, and is similar in construction to release latch 44. Spring 61 and spring 62 of the shock absorbing means 60 absorb the shock caused by the impact of escape pole means 20 against latch 50 when escape pole means 20 is pivoted from its stored or standby position to the ready, operational position.

A counterbalance means, comprising a counterbalance 25 attached to an end of counterbalance section 22, serves to approximately balance the weight of the portions of escape pole means 20 on opposite sides of pivotal connection 26. This facilitates the retrieval of escape pole means 20 from its operational position to its stored position, and reduces the force with which escape pole means 20 impacts second latch means 50. The portion of escape pole means 20 on the opposite side of the pivotal connection 26 from counterbalance 25 is left slightly heavier, however, to provide for rapid vertical alignment by gravitational force of elongate section 21 when an emergency arises.

A light fixture 70 is attached to strongback 23 to provide illumination when an emergency occurs at night. A switch may be provided on support structure 30 or, preferably, means may be provided to automatically switch on light fixture 70 when escape pole means 20 is pivoted from the stored position to the operational position.

Support structure 30 has a deck 37, hand rails, and an access gate 38, and is attached in a conventional manner to offshore platform 1 such that its deck 37 is at approximately the same level as deck 2 of platform 1, and access gate 38 is at the same level as handrail 3 of the platform.

Figure 2:
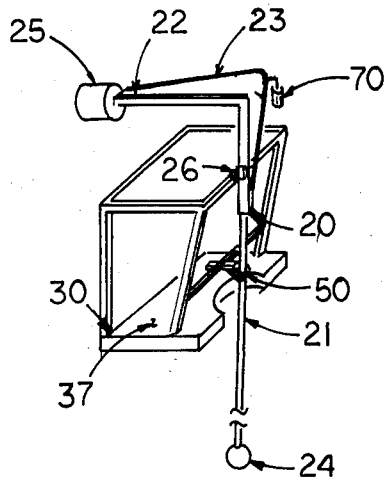
FIG. 2 is a perspective view of the apparatus shown in Fig. 1 in an operational position.
Figure 3:
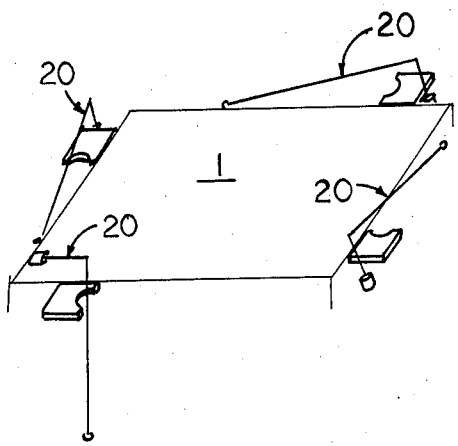
FIG. 3 shows a plurality of escape devices of the present invention installed on an offshore platform.

An offshore platform would usually have four escape pole means 20, placed as indicated in FIG. 3. One of the escape pole means 20 in FIG. 3 is shown in the operational position, and the rest are shown in the stored position, for purposes of illustration only. Normally, all poles would be in the stored position, as indicated in FIG. 1, until they are needed for an emergency, in which case they would be allowed to pivot into the second or operational position shown in FIG. 2.

In case of emergency, such as the outbreak of a fire on the offshore platform, remote release cable 49 is pulled, opening release latch 44. This allows elongate section 21 of escape pole means 20 to pivot, by gravitational force, into a substantially vertical orientation as shown in FIG. 2. Locking latch 50 receives elongate section 21, and shock-absorbing means 60 absorbs the shock caused by the impact of escape pole means 20 against locking latch 50. With the escape pole means 20 in the ready position, rig personnel can then hold onto elongate section 21, and slide down. Guard 24 is now located adjacent the surface of the water, and, depending on the length of elongate section 21, is positioned above, below, or at the surface of the water. Preferably, the length of elongate section 21 is such that ball 24 is located just above the surface of the water. Guard 24 covers the end of elongate section 21, reducing the chance that personnel will be injured if wave action causes them to impact the end of elongate section 21 once they are in the water.

When the fire has been extinguished and normal operations are to resume on the platform, locking latch 50 is opened and escape pole means 20 is returned to the stored position in which escape pole means 20 is received in release latch 44.

Figure 6:
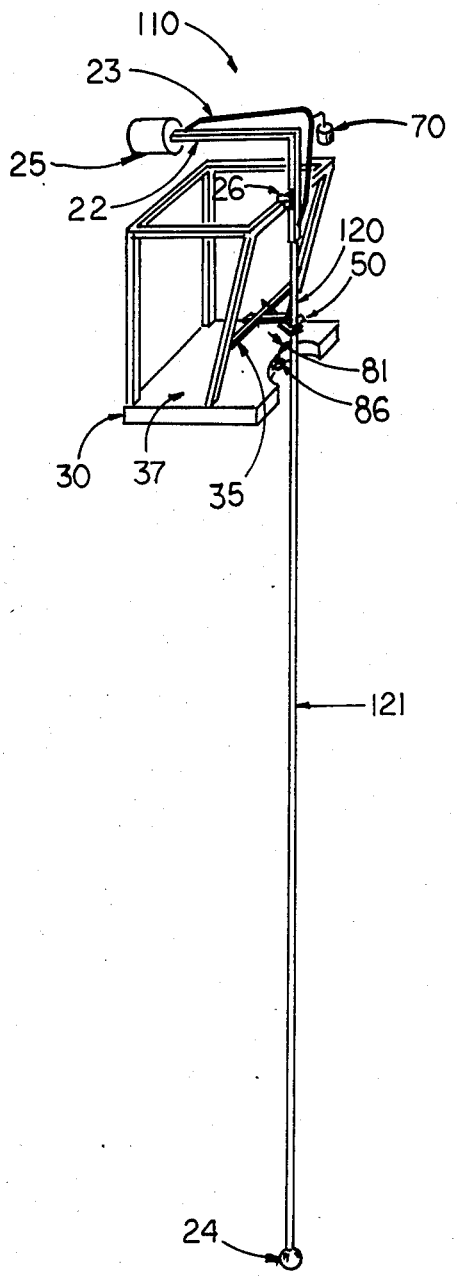
FIG. 6 is a perspective view of an alternative embodiment of the apparatus of the present invention.
Figure 7:
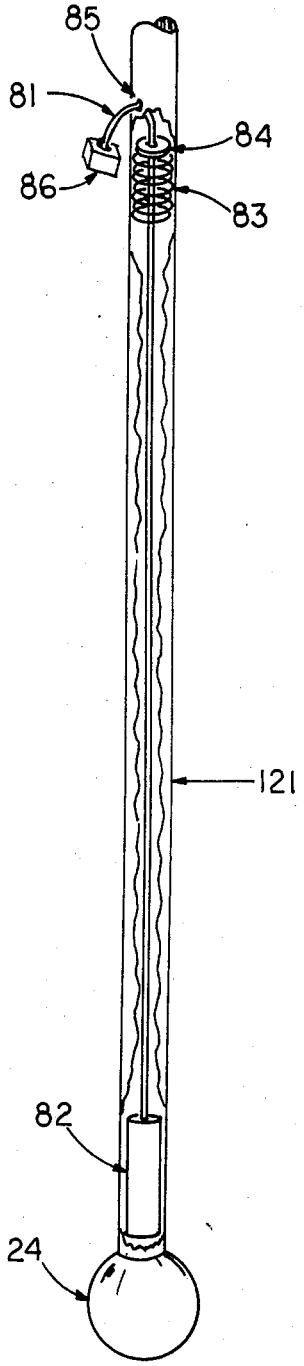
FIG. 7 is a partially cut-away view of a detail of the embodiment shown in FIG. 6.

An alternative embodiment of the apparatus of the present invention is illustrated in FIGS. 6 and 7. The apparatus 110 of this embodiment is similar to the apparatus 10 of the preferred embodiment, and further comprises a novel cable and counterweight system to assist in the evacuation of personnel from relatively high platforms. The structure and operation of the basic apparatus having already been described, the discussion of the alternative embodiment will be confined to the cable and counterweight system. As will be explained, this embodiment is particularly advantageous for use with relatively high structures or platforms.

A cable 81 (see FIG. 7) extends from a counterweight 82 through a spring 83, a plug 84, and a pair of rollers 87, 88 securely mounted on support plate 89. The plate 89 is fixedly attached, as by welding, to the interior of the elongate section 21 adjacent a port 85 made through the wall of the section 21.

A corresponding port 90 is made through the support plate in such a manner that their axes coincide and cable 81 is allowed to pass through rollers 87, 88 then ports 90 and 85, to finally extend outwardly from the elongate section 21. Cable 81 is connected at one end to counterweight 82, and connected at its other end to a securing means 86. Securing means 86 comprises a device which may be detachably connected to a life vest (not shown), or could optionally be constructed to wrap around and secure to a person's body.

When an emergency occurs, and escape pole means 120 is in the ready position, a person (not shown) secures himself to a securing means 86 by, for example, attaching securing means 86 to his life vest (not shown) while standing on platform 37 of structure 30. He then slides down elongate section 121 toward the water. Gravitational force on the person tends to make him slide rapidly down the pole and, were it not for the cable and counterweight system of this embodiment, only the frictional contact of his body with the pole would, in part, counteract this force. It can thus be seen that, when evacuating via escape pole means 120 from a relatively high platform, the person could impact the water with considerable force. When employing the novel cable and counterweight system of this embodiment, however, additional forces counteract the gravitational force on the person. As he slides down, counterweight 82 slides up inside the elongate section 121. The gravitational force opposing the upward movement of counterweight 82 is a major force counteracting the gravitational force on the person. The frictional contact of cable 81 with plug 84 and port 85 also serves as a counteracting force, helping slow the person's descent down elongate section 21. Finally, as he nears resilient ball 24, counterweight 82 compresses spring 83 against plug 84, further reducing the force of his impact with the water. Once in the water, he detaches securing means 86 from his life vest. The counterweight 82 then descends in elongate section 121, returning securing means 86 to the ready position so that another person can utilize it.

The various components of the apparatus of the present invention may be fabricated of any suitable corrosion-resistant materials durable enough to withstand the offshore environment and strong enough to perform their desired function. The support structure, for example, may be constructed of steel with a corrosion-resistant coating, such as paint, and the elongate portion of the escape pole means may comprise a non-corrosive, smooth material such as stainless steel tubing.

While only two embodiments of the present invention have been described in conjunction with the accompanying drawings, there are numerous modifications which could be made thereto without departing from the spirit or scope of the present invention. For example, if the portion of the pole means opposite the pivotal connection from the counterbalance means is substantially heavier than the portion with the first counterbalance means, the locking latch could be omitted. Also, the escape pole could be mounted such that the elongate portion extends outwardly from the platform deck when in the stored position, instead of alongside the deck. In this case, a support structure for the escape pole could be mounted on the deck as opposed to adjacent the deck.

The present invention, therefore, is well adapted to carry out the objects and attain the advantages mentioned, as well as others inherent therein. While the presently preferred embodiments of the invention have been given for the purpose of disclosure, numerous changes in the details of construction, the combination of parts, and uses may be resorted to without departing from the spirit and scope of the present invention.

I pray therefore that my rights to the present invention be limited only by the following claims.

I claim:

1. An escape apparatus for facilitating evacuation of persons from an elevated structure, comprising:

an escape pole means comprising an elongate section;

a pivot means adjacent a first end of the elongate section for pivotally attaching said escape pole means to said structure and to allow pivotal movement of the escape pole between a stored position and a ready position in which the elongate section is disposed substantially vertically and in which a second end of the elongate section is located adjacent a surface to which the persons evacuate;

a release means for releasably retaining the escape pole means in the stored position, and wherein when said release means is opened, the escape pole means pivots, by a gravitational force, from the stored position into the ready position.

2. The apparatus of claim 1, further comprising a guard means attached to said second end of the elongate section.

3. The apparatus of claim 2, wherein the guard means comprises a resilient ball.

4. The apparatus of claim 1, further comprising locking means to releasably lock the escape pole means in the ready position.

5. The apparatus of claim 1, further comprising shock-absorbing means to absorb shock when the escape pole means is pivoted from the stored position to the ready position.

6. The apparatus of claim 1, further comprising:

counteracting means to partially counteract gravitational force on a person as the person slides down the escape pole means.

7. The apparatus of claim 6, wherein said counteracting means comprises:

a counterweight means disposed within said elongate section;

a cable means having a first end and a second end, said cable means being connected at said first end to said counterweight means, extending through a port means in said elongate section, and being connected at said second end to a securing means.

8. The apparatus of claim 7, wherein said securing means is adapted for detachable connection to a person.

9. An escape apparatus for facilitating the evacuation of personnel from an offshore platform surrounded by water, comprising:

an escape pole means comprising an elongate section;

a pivot means adjacent a first end of the elongate section for pivotally attaching said escape pole means to said structure to allow pivotal movement of the escape pole means between a stored position, in which the escape pole means is above and removed from boat traffic around the offshore platform, and a ready position, in which the elongate section is disposed substantially perpendicular to a surface of the water surrounding the platform, and a second end of the elongate section is located adjacent the surface of the water;

release means for releasably retaining the escape pole means in the stored position wherein, when said retaining means is opened, the escape pole means pivots, by gravitational force, from the stored position into the ready position;

shock-absorbing means to absorb shock when the escape pole means is pivoted from the stored position into the ready position;

locking means to releasably lock the escape pole means in the ready position; and a guard means, attached to said second end of the elongate section.

10. The apparatus of claim 9, further comprising:

counteracting means to partially counteract gravitational force on a person as the person slides down the escape pole means.

11. The apparatus of claim 10, wherein said counteracting means comprises:

a counterweight means disposed within said elongate section;

a cable means having a first end and a second end, said cable means being connected at said first end thereof to said counterweight means, extending through a port means in said elongate section, and being connected at said second end thereof to a securing means.

12. The apparatus of claim 11, wherein said securing means is adapted for detachable connection to a person.

13. The apparatus of claim 9, wherein said guard means comprises a resilient ball.

14. An escape apparatus for an elevated structure, having a horizontal axis and a vertical axis, comprising:

an L-shaped escape pole means, having a short leg and a long leg, the escape pole means being pivotally attached to the structure for movement between a first, stored position and a second, operational position in which the long leg is substantially parallel to the vertical axis of the structure;

a counterbalance means carried by the short leg of the escape pole means;

a first latch means for securing the escape pole means in its first position;

a second latch means for locking the escape pole means in its second position; and a release means for releasing the escape pole means from engagement by the first latch means to allow the long leg to assume a substantially vertical position.

15. The apparatus of claim 14, further comprising a guard means carried by the end of the long leg opposite the short leg.

16. An escape apparatus for an elevated structure, comprising:

a support frame ridigly attached to the structure, the frame being substantially horizontally aligned with the structure;

an L-shaped escape pole means, having a short leg and a long leg, the escape pole means being pivotally attached to the support frame adjacent the short leg for movement between a first, stored position and a second, operational position when the long leg is in a substantially perpendicular relationship to the horizontal alignment of the frame;

a counterbalance means carried by the short leg of the escape pole means;

a first latch means for securing the escape pole means in a first position;

a second latch means for securing the escape pole means in its second position; and a release means for releasing the escape pole means from engagement by the first latch means to allow the long leg to assume a substantially vertical position.

17. The apparatus of claim 16, wherein the support frame comprises a deck aligned with the level of the structure from which escape is to be carried out and a superstructure extending upwardly upon the deck.

* * * * *